US010640902B2

(12) United States Patent
Eklind et al.

(10) Patent No.: US 10,640,902 B2
(45) Date of Patent: May 5, 2020

(54) DEVICE AND METHOD FOR CONTROLLING THE FIXATION OF AN IN-LINE THREAD TREATMENT

(71) Applicant: Inventech Europe AB, Jonkoping (SE)

(72) Inventors: Martin Eklind, Jonkoping (SE); Joakim Staberg, Jonkoping (SE)

(73) Assignee: Coloreel Group AB, Jonkoping (SE)

( * ) Notice: Subject to any disclaimer, the term of this patent is extended or adjusted under 35 U.S.C. 154(b) by 0 days.

(21) Appl. No.: 15/736,034

(22) PCT Filed: Jun. 16, 2016

(86) PCT No.: PCT/SE2016/050588

§ 371 (c)(1),
(2) Date: Dec. 13, 2017

(87) PCT Pub. No.: WO2016/204686

PCT Pub. Date: Dec. 22, 2016

(65) Prior Publication Data

US 2018/0187354 A1 Jul. 5, 2018

(30) Foreign Application Priority Data

Jun. 17, 2015 (SE) ..... 1550842

(51) Int. Cl.
*D05C 11/00* (2006.01)
*D05C 11/24* (2006.01)
(Continued)

(52) U.S. Cl.
CPC ..... *D05C 11/24* (2013.01); *D03J 1/04* (2013.01); *D05B 67/00* (2013.01); *D06B 1/02* (2013.01);
(Continued)

(58) Field of Classification Search
CPC ..... D06M 10/00
See application file for complete search history.

(56) References Cited

U.S. PATENT DOCUMENTS 4,465,005 A 8/1984 Eguchi et al.
4,501,588 A 2/1985 Suzuki et al.
(Continued)

FOREIGN PATENT DOCUMENTS

GB 2166766 A 5/1986
JP S5985184 A 5/1984
(Continued)

OTHER PUBLICATIONS

European Search Report for Application No. 16812048.3 dated Oct. 29, 2018.
(Continued)

*Primary Examiner* — Gordon Baldwin
*Assistant Examiner* — Mohammad Mayy
(74) *Attorney, Agent, or Firm* — Honigman LLP

(57) ABSTRACT

A method and device for controlling the fixation of a treatment material being applied to a thread during a thread treatment process are disclosed. The method comprises performing a thread treatment process, forming part of the thread consuming process, by: i) applying a treatment material to the thread; and ii) applying an amount of energy to the thread to at least partly fix the applied treatment material to the thread; wherein the method further comprises controlling the amount of energy being applied to the thread as a response to a detected operational status of the in-line thread consuming process.

14 Claims, 1 Drawing Sheet

(51) Int. Cl.

| | |
|---|---|
| ***D06B 1/02*** | (2006.01) |
| ***D03J 1/04*** | (2006.01) |
| ***D05B 67/00*** | (2006.01) |
| ***D06B 19/00*** | (2006.01) |
| ***D06M 10/00*** | (2006.01) |
| ***D06M 10/04*** | (2006.01) |

(52) U.S. Cl.
CPC ..... *D06B 19/007* (2013.01); *D06B 19/0029* (2013.01); *D06B 19/0047* (2013.01); *D06M 10/001* (2013.01); *D06M 10/04* (2013.01); *D05D 2305/28* (2013.01)

(56) References Cited

U.S. PATENT DOCUMENTS

| | | | | |
|---|---|---|---|---|
| 4,538,535 | A | 9/1985 | Hanyu et al. | |
| 6,189,989 | B1 | 2/2001 | Hirabayashi et al. | |
| 2007/0245940 | A1 | 10/2007 | Wahlstrom | |
| 2009/0241819 | A1 | 10/2009 | Tseng | |
| 2012/0040105 | A1* | 2/2012 | Overton | C03C 25/12 427/558 |
| 2014/0349034 | A1 | 11/2014 | Staberg et al. | |

FOREIGN PATENT DOCUMENTS

| | | | | |
|---|---|---|---|---|
| JP | H06304359 | A | 11/1994 | |
| JP | H09239179 | A | 9/1997 | |
| JP | 2009273675 | A | 11/2009 | |
| WO | WO-2010/076823 | A1 | 7/2010 | |
| WO | WO-2013039447 | A1 * | 3/2013 | D05C 11/24 |

OTHER PUBLICATIONS

International Search Report for PCT/SE2016/050588 dated Sep. 9, 2016.
Japanese Office Action for Application No. 2018-518561 dated Jan. 21, 2020, along with English translation.

* cited by examiner

DEVICE AND METHOD FOR CONTROLLING THE FIXATION OF AN IN-LINE THREAD TREATMENT

FIELD OF THE INVENTION

The present invention relates to a device and method for controlling a process fixating a treatment material on elongated substrates, such as threads, during a continuous, or in-line, treatment process. The invention also relates to a thread consuming device containing a thread treatment device providing such control functionality.

BACKGROUND ART

Existing devices for treatment of thread in thread consuming devices, such as within sewing or embroidery applications, require continuous in-line movement of the thread through the device. For treatment devices configured to apply a material to the thread, e.g. coloring devices, a fixation unit is normally arranged downstream a coloring unit, i.e. the fixation unit is arranged after the coloring unit in a thread movement direction. The role of the fixation unit is to fix the treatment material to the thread by applying energy to the treatment material for a pre-determined time window. However, during operation of the thread consuming device the amount of energy applied by the fixation unit may exceed or fall outside the working window corresponding to the desired energy being required to fix the treatment material. This may e.g. occur when the operation of the thread consuming device is temporarily interrupted or slowed down. The excessive energy may have a detrimental effect on the properties of the thread or the applied treatment material, as well as on the fixation process.

It would therefore be desirable to provide an improved method and device for protecting a thread from unwanted effects during a thread treatment process.

SUMMARY

An object of the present invention is to provide an improved device and method solving the above-mentioned drawbacks. An idea of the present invention is to provide a control functionality which ensures that an elongated substrate, e.g. a thread, being treated with a material requiring fixation will be subject to a fixation process. The fixation process is controlled such that the applied energy is kept within a predetermined interval which is sufficiently high for ensuring the desired fixation, while on the other hand being sufficiently low to prevent the substrate or treatment material to be damaged. In particular, the control functionality of the present invention allows improved color consistency for embodiments where the treatment unit provides thread coloring.

According to one aspect of the invention, there is provided a method for controlling the fixation of a treatment material being applied to a thread during a continuous thread treatment process, the method comprising the steps of applying a treatment material to the thread, applying an amount of energy to the thread to fix the applied treatment material to the thread, and controlling the amount of energy being applied to the thread as a response to a detected operational status, or an expected change in operational status, of the continuous thread consuming process.

The operational status of the continuous thread consuming process may be represented by the speed of the thread as it passes through a treatment unit, or the mean speed of the thread running through the thread consuming device. Other speed values of the thread may also be used for representing the operational status of the thread consuming process. In another embodiment, for which several thread treatment devices are provided, and for which each thread treatment device is associated with a corresponding embroidery head of a multi-heat embroidery machine, the operational status of the thread consuming process may represent the status of the thread consuming process controlled by another embroidery head. Also in this case the operational status may represent a predicted change in the operational status of a thread consuming process for another embroidery head.

The operational status of the thread consuming process may in other embodiments represent if the thread consuming process for one of several embroidery heads is running, or if it is interrupted or slowed down. Interruption may e.g. occur upon breakage of the thread or if an operator is intentionally stopping the thread consuming process for one of several embroidery heads, while slowing down may occur e.g. if the thread consuming process is controlled to provide shorter stitches, or lower embroidery speed.

As used herein, a thread may be glass fibre thread; a thread of wool; a thread of cotton; a synthetic thread; a metallic thread; a thread being a mixture of wool, cotton, polymer, or metal; a yarn; a filament; or any elongated substrate that is intended and/or being suitable for being applied with a coloring material or other surface coating material.

The present inventors have found that the method and device of the present invention permits a thread treatment process to be temporarily halted or slowed down (whether intentionally or unintentionally) without detrimentally impacting on the treatment result and other properties of the thread such as sewability, friction, tensile strength, elasticity, etc. The method and device of the invention further avoids thread wastage and the need to cut out unwanted thread portions.

According to a first aspect a method for controlling the fixation of a treatment material being applied to a thread during an in-line thread consuming process is provided. The method comprises: performing a thread treatment process, forming part of the thread consuming process, by: i) applying a treatment material to the thread; and ii) applying an amount of energy to the thread to fix the applied treatment material to the thread. The method further comprises controlling the amount of energy being applied to the thread as a response to a detected operational status of the in-line thread consuming process. Reducing the amount of energy being applied, which may occur if the thread consuming process is temporarily interrupted or slowed down, may be performed in a controlled manner in order to achieve gradual reduction.

For explanatory purpose, an in-line process is to be interpreted as a process running at the same time as the thread, at other positions in the thread treatment device, is subject to other processes. A continuous process is to be interpreted as a process being performed on a continuous thread.

Reducing the amount of energy may be performed by directing the applied energy at least partly away from the thread, or by moving the thread at least partly away from the direction of the applied energy.

Reducing the amount of energy may in other embodiments be performed by simultaneously moving the thread and directing the applied energy at least partly away from each other, by reducing or stopping the application of energy, by cooling the thread and/or the energy supply, and/or by stopping the application of energy and cooling the thread and/or the energy supply.

Cooling the thread and/or the energy supply may be performed prior to stopping the supply of energy.

In an embodiment, applying an amount of energy to the thread comprises at least one of i) arranging the thread adjacent to a heating element, ii) exposing the thread to UV light and/or visible light and/or infrared light, iii) exposing the thread to an electron beam or a charged particle beam, iv) exposing the thread to heated air or steam.

Arranging the thread adjacent to a heating element may be performed by arranging the thread at a distance from the heating element.

In an embodiment, reducing the amount of energy being applied to the thread is performed as a response to a change, or expected change, of the operational status of the thread consuming process. The change, or expected change of operational status may be represented by a control signal being transmitted to the fixation unit and/or a thread positioning device for controlling the amount of energy being applied to the thread. The control signal may e.g. contain information representing the thread speed, thus indicating if the thread consuming process is temporarily interrupted or slowed down.

The control signal representing a change, or expected change of the operational status of the thread consuming process may be transmitted upon unintentional interruption of the thread consuming process, or upon breakage of the thread.

The method may further comprise tensioning the thread while reducing the amount of energy.

The method may further comprise resuming the thread treatment process when the thread consuming process is restarted after the change in operational status. Preferably, such resuming of the thread treatment process also initiates an increase of energy being applied to the thread. The increase of applied energy may preferably be performed in the same manner as it has been described above with respect to a reduction in applied energy, although in reversed order. Preferably, in case of an interruption the thread will remain at the same position during the period of change in operational status. Maintaining the thread in the same position may e.g. be accomplished by means of a thread tension device. Hence, the thread treatment process may continue at the position of the thread that previously was subjected to the treatment process when the change in operational status occurred. In case of change of thread speed the method may comprise a step of controlling the amount of applied energy, or controlling the tension of the thread, as a compensation for the effects caused by the thread speed change.

The thread consuming process may be sewing, weaving, or embroidering.

In an embodiment, applying a treatment material to the thread comprises coloring the thread.

According to a second aspect an in-line thread treatment device for use with an associated thread consuming device is provided. The thread treatment device comprises a treatment unit configured to apply a treatment material to the thread; a fixation unit configured to apply an amount of energy to the thread to fix the applied treatment material to the thread; and a control unit configured to control the amount of energy being applied to the thread as a response to a detected operational status of the associated in-line thread consuming process.

The fixation unit may be configured to be displaced relative the thread in order to change the amount of energy being applied to the thread.

The device may further comprise a thread guiding unit configured to move the thread away from the fixation unit in order to reduce the amount of energy being applied to the thread. Optionally, the thread guiding unit is configured to maintain the position of the thread relative the fixation unit, while the fixation unit is controlled to adjust the amount of energy being applied for compensating the effects caused by a thread speed change. The thread guiding unit is preferably configured to allow for a restart, retardation, or acceleration of the thread consuming process without affecting the thread treatment process negatively.

The fixation unit and the thread may be configured to simultaneously move away from each other.

In an embodiment the control unit is configured to stop the application of energy from the fixation unit.

The fixation unit may comprise a cooling section for cooling the thread and/or the fixation unit. The cooling section may comprise a fan.

The fixation unit may comprise at least one of a heating element, a source providing heated air or steam, a UV light source, a visible light source, an infrared light source, an electron beam source, and/or a charged particle beam source for applying an amount of energy to the thread.

In an embodiment, the control unit is further configured to reduce the amount of energy being applied to the thread as a response to a change, or expected change, of the operational status of the thread consuming process. The change, or expected change of operational status may be represented by a control signal being transmitted to the fixation unit and/or a thread positioning device for controlling the amount of energy being applied to the thread. The control signal may e.g. contain information indicating if the thread consuming process is temporarily interrupted or slowed down, such as upon unintentional interruption or upon breakage of the thread.

The device may further comprise a thread tensioning unit which may be located after the treatment unit, but before (i.e. upstream) the fixation unit for tensioning the thread during the interruption. Other positions of the thread tensioning unit are also possible, as long as the thread tensioning unit is configured to allow for a restart, retardation, or acceleration of the thread consuming process without affecting the thread treatment process negatively.

Within this specification, all references to upstream and/or downstream should be interpreted as relative positions during normal operation of the device, i.e. when the device is operating to treat an elongated substrate, such as a thread, continuously moving through the device in a normal operating direction. Hence, an upstream component is arranged such that a specific part of the thread passes it before it passes a downstream component.

In an embodiment the treatment unit is a thread coloring unit. The thread coloring unit may comprise an inkjet unit configured to apply a liquid, preferably a dye, an ink, or a combination thereof, to the thread.

According to a third aspect, a thread consuming device, such as an embroidery machine, a sewing machine, or a weaving machine, is provided. The thread consuming device comprises the device according to the second aspect.

BRIEF DESCRIPTION OF THE DRAWINGS

Embodiments of the invention will be described in the following; reference being made to the appended drawings which illustrate non-limiting examples of how the inventive concept can be reduced into practice.

DETAILED DESCRIPTION

As previously mentioned, aspects of the invention relate to a method and device for controlling the fixation of a treatment material being applied to a thread when the operational status of a continuous thread treatment process is changed, e.g. by being temporarily interrupted or slowed down.

Figure 1:
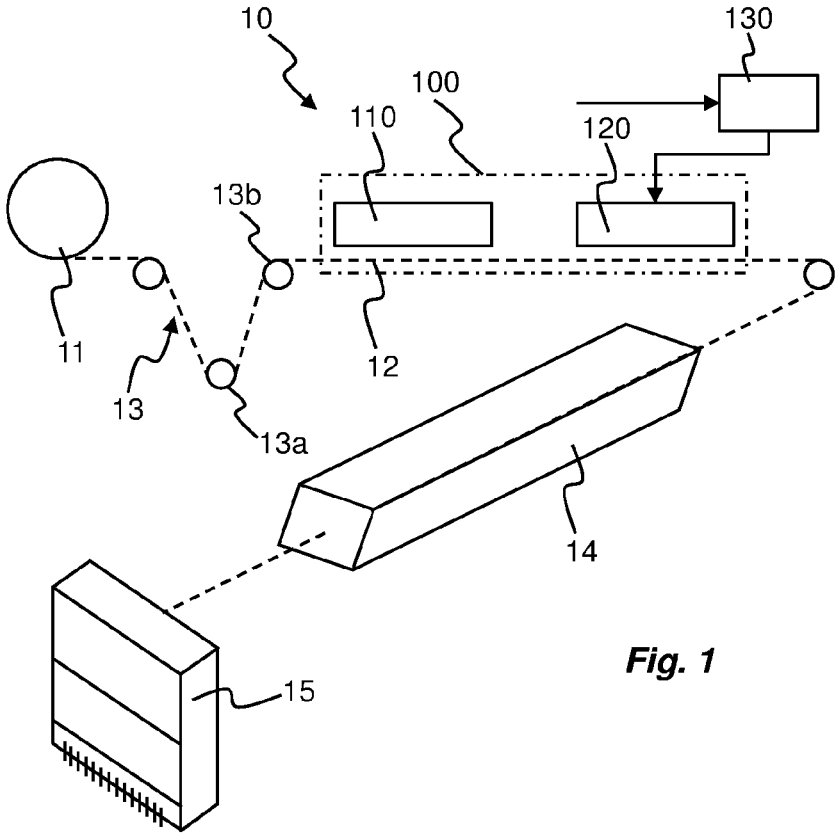
FIG. 1 shows a thread consuming device according to an embodiment.

A thread consuming device, in the form of an embroidery machine 15, is schematically shown in FIG. 1. The embroidery machine 15 receives thread 12 to be embroidered, and thus consumed, from a thread processing unit 10. The thread processing unit 10 comprises an in-line thread treatment device 100 as will be further described below. The thread consuming device 15 may in some embodiments be a weaving machine or a sewing machine, or other suitable thread consuming devices.

As can be seen in FIG. 1 the thread processing unit 10 comprises a thread supply 11 providing feeding of thread 12 through the thread processing unit 10 by means of at least one thread feeding unit 13. The thread feeding unit may e.g. comprise one or more driven rollers 13*a*, 13*b* which apply a pulling force on the thread for urging the thread 12 to move downstream, i.e. in a forward direction through the thread processing unit 10.

The thread treatment device 100 is arranged downstream the thread supply 11, i.e. after the thread supply 11 in the direction of thread movement. The thread processing unit 10 may further comprise additional units or devices 14 which are arranged downstream the thread treatment device 100.

Such additional units or devices 14 may e.g. include thread cleaning devices, thread tension devices, thread measurement devices, thread lubrication devices, etc. At the end of the thread processing unit 10 the embroidery head 15 (or other suitable thread consuming device such as weaving machine, sewing machine, etc) is provided, wherein the thread consumption occurs when the embroidery head 15 is operational to embroider a pattern onto e.g. a fabric.

In a preferred embodiment the thread treatment device 100 is an in-line treatment device which means that treatment of thread 12 is performed as the thread 12 moves through the treatment device 100. The thread treatment device 100 has a treatment unit 110 configured to apply a treatment material to the thread 12, a fixation unit 120 configured to apply an amount of energy to the thread 12 to fix the applied treatment material to the thread 12, and a control unit 130 configured to control the amount of energy being applied to the thread 12 during operation of the associated in-line thread consuming process.

The treatment unit 110 is preferably configured to apply a coloring material to the thread 12. Hence, the treatment unit 110 may comprise one or more inkjet devices, each inkjet device having an associated number of inkjet nozzles for discharging a predetermined amount of color to the thread 12 in a controlled manner. The coloring material may e.g. be a dye, and ink, or a similar liquid or powder being suitable for changing the coloring of the passing thread 12. The treatment unit 110 is preferably controlled by means of an additional control unit, either provided as a separate component or formed integral with the control unit 130, which control unit is configured to control the operation of the treatment unit 110 such that the applied material is dispensed according to a predetermined scheme. Preferably, the control unit 130 associated with the fixation unit 120 is in communication with the control unit being associated with the treatment unit 110. In such embodiment the control unit 130 may receive input relating to thread treatment properties, and thereby adjust the fixation process accordingly.

In order to fixate the coloring material to the thread 12, the fixation unit 120 is configured to apply a certain amount of energy to the thread 12. The fixation device 120 may e.g. comprise a heating element and an associated power supply, such that the thread 12 is exposed to heat when passing the fixation unit 12. In another embodiment, the fixation device 120 may comprise a supply of heated air or steam.

In another embodiment the fixation device 120 comprises at least one of a UV light source, a visible light source, and/or an infrared light source. Associated power source(s) and associated sensor(s) may also be provided for allowing an accurate control of the intensity of the light source(s).

In a yet further embodiment the fixation device 120 comprises an electron beam source and/or a charged particle beam source, as well as an associated power source and sensor(s), for applying an amount of energy to the thread.

In another embodiment the fixation device 120 comprises a combination of a heating element, a supply of heated air or steam, a light source, and/or a beam source.

As has already been described above the control unit 130 is configured to control the amount of energy being applied to the thread 12 as a response to a change, or expected change, of an operational status of the associated in-line thread consuming process. The change, or expected change of operational status may be represented by a control signal being transmitted to the fixation unit and/or a thread positioning device from the control unit 130 for controlling the amount of energy being applied to the thread. The control signal may e.g. contain information representing the thread speed, thus indicating if the thread consuming process is temporarily interrupted or slowed down. This may be accomplished in various ways.

Figure 2A:
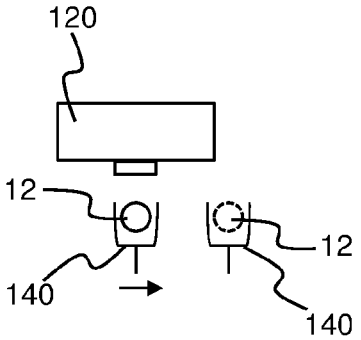
FIG. 2*a* is a front view of a thread treatment device according to an embodiment.

According to one embodiment the thread treatment device 100 further comprises a thread guiding unit 140. The thread guiding unit 140 serves the purpose of aligning the thread 12 along a desired direction. The thread guiding unit 140 may be arranged just upstream the fixation unit 120 such that the thread 12 is aligned with the heating element and/or supply of heated air or steam and/or light source and/or beam along the entire extension of the fixation unit 120. As can be seen in FIG. 2*a*, the thread guiding unit 140 is formed as a V-shape or U-shape for delimiting the lateral, or transversal movement of the thread 12.

In one embodiment, the thread guiding unit 140 may be arranged at a position along the thread direction. Upstream the thread guiding unit 140 the thread 12 is positioned laterally displaced from the desired feeding direction through the fixation unit 120. The thread guiding unit 140, being positioned upstream the fixation unit 120, may in such embodiment have an I-shape guiding the thread 12 into the desired feeding direction.

The thread guiding unit 140 of FIG. 2*a* may in some embodiments be configured to move transversely such that the thread 12 moves away from the fixation unit 120 in order to reduce the amount of energy being applied to the thread 12. However, the thread guiding unit 140 may also be configured such that no additional thread 12 is consumed. Hence, undesired effects such as a slack or overlap are prevented.

One or more additional thread guiding units may be arranged upstream the treatment unit 110 in order to align the thread 12 with the plurality of inkjet nozzles of the treatment unit 110.

Figure 2B:
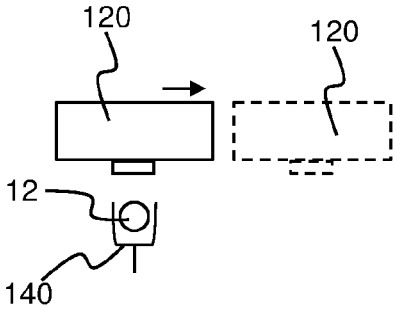
FIG. 2*b* is a front view of a thread treatment device according to a further embodiment.

In a further embodiment, shown in FIG. 2*b*, the thread guiding unit 140 is fixed; however the fixation unit 120 is configured to be displaced relative the thread 12 in order to reduce the amount of energy being applied to the thread 12. The fixation unit 120 may move transversely, as is shown in FIG. 2*b*, or it may move rotationally or vertically or any combination of these as long as the energy applied to the thread 12 is reduced.

A yet further embodiment may also be realized in which the thread 12, as well as the fixation unit 120, are moved relative each other.

In another embodiment the lateral position of the thread 12 is fixed, and the position of the fixation unit 120 is also fixed. In order to reduce the amount of energy directed towards the thread 12 an isolation member (not shown) may be inserted between the energy source of the fixation unit 120 and the thread 12.

Figure 2C:
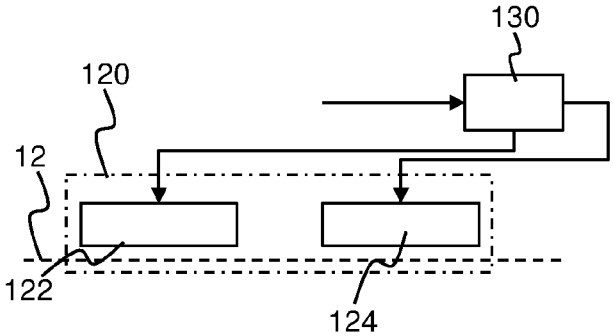
FIG. 2*c* is a side view of a thread treatment device according to an embodiment.

FIG. 2*c* shows a yet further embodiment of the fixation unit 120. Here, the fixation unit 120 has a fixation section 122 and a cooling section 124. The cooling section 124 may be arranged in series downstream the fixation section 122, or they may be arranged in parallel.

The cooling section 124, comprising a cooler, may be activated when the control unit 130 is operating to adjust the amount of energy being applied to the thread 12. The cooler of the cooling section 124 may provide cooling of the thread 12, cooling of the fixation section 122, or both. For best performance the cooling section 124 is preferably provided for configuration where the fixation section 122 includes the heating element previously described. The cooling section 124 may comprise a fan or other cooling devices, such as a peltier element or similar.

The control unit 130 is configured to receive one or more signals representing the operation, or operational status, of the thread consuming device. The signal(s) may be received continuously such that any occurring change in the operational status, such as breakage of the thread 12 or other temporarily interruption or thread speed reduction, will cause a change in control of the fixation unit 120. Once the signals corresponding to a required control of the fixation unit 120 are received the control unit 130 will send a control signal to the fixation unit 120 to adjust the amount of energy being applied to thread. The control unit 130 may thus be connected to the power supply of the fixation unit 120, i.e. the power supply of the heating element or supply of heated air or steam or light source or beam source, as well as to the cooling section if such is provided. Further, the control unit 130 may in some embodiments control the position of the thread 12 and/or the position of the fixation unit 120. The thread 12 will thus be protected from excessive energy application, which otherwise may damage the thread 12. Sensors may be provided to provide real time measurements of the actual operation of the fixation unit 120, thus improving control.

In one embodiment the control unit 130 is configured to control complete termination of the energy application. In other embodiments the control unit 130 is configured to decrease the amount of energy being applied to the thread 12. In general terms, the control unit 130 is configured to adjust the amount of energy being applied to the treated thread 12 such that sufficient fixation is achieved without causing detrimental effects on the thread 12 and/or the treatment material.

The adjustment of the energy being directed towards the thread 12 may be controlled in order to allow for thread speed reduction, or in case the thread 12 or coating material is more sensitive to applied energy. Specifically, a coating material such as a coloring material may require a specific amount of energy, e.g. by means of heating, in order to be fixated onto the thread 12. In case the fixation unit 120 comprises a heater, the properties of the thread 12 and the applied coating material will define a working window resulting in a desired fixation; the working window is set by the temperature and the time period for which the coating material is exposed to the temperature. In case the fixation unit 120 comprises a light source, the properties of the thread 12 and the applied coating material will define a working window resulting in a desired fixation; the working window is set by the radiation intensity and the time period for which the coating material is exposed to the radiation.

In case the fixation unit 120 comprises a supply of hot air or steam, the properties of the thread 12 and the applied coating material will define a working window resulting in a desired fixation; the working window is set by the temperature of the hot air and steam, and the flow of the hot air or steam.

Should there be a temporarily interruption or thread speed reduction the thread 12 will move slower (or not at all) through the fixation unit 120, which means that the time period for which the thread 12 is exposed to the elevated temperature or radiation is significantly increased. Therefore, the control unit 130 is configured to reduce the temperature or radiation intensity, in ways being described above, such that the working window as described above remains within an acceptable interval.

The control unit 130 is also configured to detect when the thread consuming process returns to normal operation, i.e. normal thread speed. Upon such detection the fixation unit 120 is again controlled to keep the working window of the fixation unit 120 within the acceptable interval such that the coating material is fixated without causing detrimental effects on the thread 12 or the coating material.

Although the present invention has been described above with reference to specific embodiments, it is not intended to be limited to the specific form set forth herein. Rather, the invention is limited only by the accompanying claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A method for controlling a fixation of a treatment material being applied to a thread during a continuous in-line thread consuming process being sewing, weaving, or embroidering, the method comprising:

performing a thread treatment process, forming part of the thread consuming process, by:

i) discharging, using one or more inkjet nozzles, a predetermined amount of treatment material to the thread; and ii) applying an amount of energy to the thread to at least partly fix the applied treatment material to the thread; wherein the method further comprises:

controlling the amount of energy being applied to the thread as a response to a change, or expected change, of the operational status of the in-line thread consuming process, wherein controlling the amount of energy is performed by moving the fixation unit relative the thread in order to reduce the amount of energy being applied to the thread, and/or by moving the thread away from the fixation unit in order to reduce the amount of energy being applied to the thread, wherein the thread is moved by a thread guiding unit that moves the thread in a transverse direction.

2. The method according to claim 1, wherein controlling the amount of energy is performed by stopping the application of energy.

3. The method according to claim 1, wherein controlling the amount of energy is performed by cooling the thread and/or the energy supply.

4. The method according to claim 1, wherein controlling the amount of energy is performed by adjusting the amount of energy being applied, and/or cooling the thread and/or the energy supply.

5. The method according to claim 4, wherein cooling the thread and/or the energy supply is performed prior to stopping the supply of energy.

6. The method according to claim 1, wherein applying an amount of energy to the thread comprises at least one of i) arranging the thread adjacent to a heating element, ii) exposing the thread to UV light and/or visible light and/or infrared light, iii) exposing the thread to an electron beam or a charged particle beam, iv) exposing the thread to heated air or steam.

7. The method according to claim 6, wherein arranging the thread adjacent to a heating element is performed by arranging the thread at a distance from the heating element.

8. The method according to claim 1, wherein reducing the amount of energy being applied to the thread is performed as a response to a change, or expected change, of the operational status of the thread consuming process.

9. The method according to claim 8, wherein a control signal representing a change, or expected change of the operational status of the thread consuming process is transmitted upon unintentional, or intentional interruption of the thread consuming process.

10. The method according to claim 9, wherein the control signal representing a change, or expected change of the operational status of the thread consuming process is transmitted upon breakage of the thread or when the thread is stuck.

11. The method according to claim 1, further comprising tensioning, or relaxing, the thread while reducing the amount of energy.

12. The method according to claim 1, further comprising resuming the thread treatment process when the thread consuming process is restarted after a change in thread speed.

13. The method according to claim 1, wherein applying a treatment material to the thread comprises coloring the thread.

14. The method according to claim 1, wherein a position of the thread relative to the thread treatment process is maintained while controlling the amount of energy being applied to the thread.

* * * * *